United States Patent [19]

Mowli

[11] Patent Number: 4,944,657

[45] Date of Patent: Jul. 31, 1990

[54] TWO-STAGE PUMPING APPARATUS WITH LOW SHEAR FIRST STAGE

[76] Inventor: John C. Mowli, 640 Sanders Ct., Gurnee, Ill. 60031

[21] Appl. No.: 317,460

[22] Filed: Mar. 1, 1989

[51] Int. Cl.[5] ..... F04B 25/14; F01C 1/16; A22C 11/02

[52] U.S. Cl. ..... 417/203; 417/900; 418/201.1; 17/40

[58] Field of Search ..... 17/35–42; 366/85, 301; 418/9, 201; 417/900, 203; 425/208

[56] References Cited

U.S. PATENT DOCUMENTS

| | | | |
|---|---|---|---|
| Re. 18,527 | 7/1932 | Simmons . | |
| 1,164,546 | 12/1915 | Neuland . | |
| 2,358,815 | 9/1944 | Lysholm . | |
| 2,543,894 | 3/1951 | Colombo . | |
| 2,592,476 | 4/1952 | Sennet . | |
| 2,889,574 | 12/1956 | Thielen et al. | 17/39 |
| 2,966,698 | 1/1961 | Thielen | 17/40 |
| 2,975,963 | 3/1961 | Nilsson . | |
| 2,994,562 | 8/1961 | Zalis . | |
| 3,072,624 | 1/1963 | Akaboshi et al. . | |
| 3,174,784 | 9/1964 | Sloan | 17/35 |
| 3,198,132 | 8/1965 | Zalis | 418/201 R |
| 3,279,682 | 10/1966 | Vagenius . | |
| 3,467,300 | 9/1969 | Schibbye . | |
| 3,481,532 | 12/1969 | Fraser . | |
| 3,734,635 | 5/1973 | Blach et al. . | |
| 3,807,911 | 4/1974 | Caffrey . | |
| 3,817,496 | 6/1974 | Kratochvil et al. . | |
| 3,900,187 | 8/1975 | Loomans . | |
| 4,017,241 | 4/1977 | Papinchak et al. . | |
| 4,132,845 | 1/1979 | Covington, Jr. et al. | 425/208 |
| 4,529,363 | 7/1985 | Suzuki . | |
| 4,792,294 | 12/1988 | Mowli . | |

FOREIGN PATENT DOCUMENTS

| | | |
|---|---|---|
| 967196 | 10/1950 | France . |

OTHER PUBLICATIONS

Doering Pump Feeders, Jun. 1981 (4 sheets).
CFP-Continuous Filter Press (2 sheets).
Luwa Polymer Technology HS-19 (12 sheets).

*Primary Examiner*—Leonard E. Smith
*Assistant Examiner*—John A. Savio, III
*Attorney, Agent, or Firm*—Dressler, Goldsmith, Shore, Sutker & Milnamow, Ltd.

[57] ABSTRACT

A two-stage pumping apparatus is provided with a pump housing through which gross movement of material occurs generally from an infeed opening to a discharge opening. A first stage non-positive displacement helical flight auger is provided in a first stage region above, and coaxial with, one of a pair of second stage augers each having a positive displacement helical flight for engaging the material and for being respectively intermeshed to provide positive displacement pumping.

21 Claims, 2 Drawing Sheets

TWO-STAGE PUMPING APPARATUS WITH LOW SHEAR FIRST STAGE

TECHNICAL FIELD

The present invention relates generally to a pumping apparatus including a pair of cooperating screw augers, and more particularly to a two-stage pumping apparatus particularly suited for pumping highly viscous liquids, semi-solids and like materials which otherwise are not readily pumped.

BACKGROUND OF THE INVENTION AND TECHNICAL PROBLEMS POSED BY THE PRIOR ART

Commercial preparation of many different food and non-food products requires the use of pumping equipment suited for pumping materials which do not readily flow or are otherwise difficult to pump. For example, food products such as cheeses, lards and shortenings, ground meat, sugars, and doughs typically require the use of specialized, multi-stage pumping devices for effecting desired movement of such materials. Similarly, non-food products such as adhesives, soaps, putties and caulking compounds, and the like require the use of specialized pumping equipment if efficient handling is to be achieved.

A pumping apparatus is disclosed in U.S. Pat. No. 4,792,294. This apparatus has been found to effectively pump products which do not readily flow and for which the pump is particularly well suited. The pumping apparatus includes a pair of cooperating, counter-rotating screw augers within a housing. Each of the screw augers includes helical flights intermeshed with the flights of the other auger, and the flights are configured to provide a two-stage pumping action—namely, (1) a first, upstream, non-positive displacement pumping, and (2) a second, downstream, positive displacement pumping.

Although the pump disclosed in U.S. Pat. No. 4,792,294 is particularly effective in pumping materials which do not readily flow, it has been unexpectedly discovered that some such materials, while being effectively pumped per se, can nevertheless, under some conditions, undergo a change in character, consistency, or other material properties. With some products, significant changes in properties may be characterized as a loss of product integrity which is of such a nature as to render the product commercially unacceptable.

For example, the pump described in U.S. Pat. No. 4,792,294 employs the intermeshed helical flights of the two augers in the non-positive displacement stage to feed the material downstream to the intermeshed helical flights of the positive displacement pumping stage. With some materials and/or by intentional pump design, there may be a tendency in some situations for the material to be pumped at a higher flow rate through the non-positive displacement first stage than through the positive displacement pump second stage.

Since the positive displacement second stage can only handle a generally constant flow rate at any set speed of pump operation, the tendency of the non-positive displacement first stage to produce a higher flow rate results in the material "slipping" relative to the non-positive displacement first stage helical flights. That is, since not all of the flow rate of material which could be pumped by the first stage can be handled by the second stage, some of that material in the first stage must remain in the first stage while the first stage helical flights rotate against and past that material. This can result in shear forces being applied to the material as the material "slips" relative to the first stage helical flights or "slips" relative to some of the other material that is being carried with, and pumped by, the first stage helical flight.

The shear forces imposed upon portions of the material in the first stage as a result of the above-described "slip" may result in excessive shear strain in the material that can change the character of the material. This excessive shear strain may also be characterized as excessive "working" of the material such that the material may lose its desired characteristics or integrity.

Italian sausage meat is one food product material which is sensitive to the imposition of shear forces. Italian sausage meat contains a significant quantity of fat compared to other meat products, including even other types of sausage meat. If the Italian sausage meat is subjected to excessive shear forces and resulting strain, then the sausage meat will appear to be smeared with fat all over the exposed surfaces. The desired visual demarcation or boundaries between the lean meat and fat is thus undesirably eliminated. Such a condition is commercially less acceptable.

Of course, it is to be realized that the advantages described for the pumping apparatus in U.S. Pat. No. 4,792,294 still exist with respect to the actual pumping per se of material regardless of the fact that the material character may change. In particular, even though the material characteristics may change owing to slippage in the first stage of a pumping apparatus of the type described in U.S. Pat. No. 4,792,294, that pumping apparatus nevertheless functions as designed for such material to provide the desired non-positive displacement pumping action to continuously feed the positive displacement downstream stage so as to avoid cavitation. By providing the first and second pumping stages in immediate succession, a pressure drop at the transition is desirably avoided.

Further, the arrangement of the pumping apparatus desirably promotes "piercing" of the material being fed by gravity into the pumping apparatus so as to avoid the problems of "tunneling" and "bridging" which had been heretofore common with other pumping apparatus constructions.

The pumping apparatus is also effective to pump such materials at the desired flow rate of the positive displacement pumping stage—regardless of slippage in the non-positive displacement pumping stage—in a manner that permits driving the pump from a drive mechanism at the downstream (outlet) end. This permits the use of positive pressure dynamic seals at drive shafts at the downstream end where the pumping apparatus is subjected to positive pressure so that sealing is more easily achieved in comparison to sealing around drive shafts at the pumping apparatus upstream end which may be subject to vacuum from an upstream processing stream, such as sometimes occurs in the processing of certain cheeses, for example.

Nevertheless, even though difficultly flowable materials can be advantageously pumped by the pumping apparatus described in U.S. Pat. No. 4,792,294, it would be desirable to provide an improved pumping apparatus for use with materials that are particularly shear sensitive so as to eliminate, or at least substantially reduce, the application of excessive shear strain on the material which might cause it to change its material characteristics.

It would be advantageous to provide such an improved apparatus for pumping, without excessive shear strain, shear sensitive materials that may be characterized as thixotropic or non-newtonian.

Further, it would be desirable to provide an improved pumping apparatus in which a more gentle, non-positive pumping action is provided and in which some sort of inherent adjustability may be incorporated into the non-positive displacement pumping action.

It would be especially beneficial if such an improved pumping apparatus could accommodate, in a manner that reduces imposition of shear forces on the material, a tendency of the first stage to effect a higher flow rate than can be handled by the second stage.

Further, it would be desirable to provide an improved pumping apparatus in which the inlet geometry could be adapted to reduce the shear forces applied to the material.

In applications where the pumping apparatus is connected directly to the outlet of equipment maintained under vacuum, such as a continuous evaporator, it would be desirable to provide an improved pumping apparatus for creating and maintaining a net positive suction pressure at the positive displacement stage of the pumping apparatus.

Finally, it would be desirable, especially in food product applications, to provide an improved pumping apparatus for effecting a sanitary pumping operation. In particular, it would be desirable to provide, to the extent possible, a "first in-first out" pumping operation, especially with food materials having characteristics sensitive to imposed shear forces.

SUMMARY OF THE INVENTION

In accordance with the present invention, a two-stage pumping apparatus is provided with a pump housing through which material is pumped. The housing defines (1) a material infeed opening, (2) a first stage non-positive displacement pumping region communicating with the infeed opening, (3) a second stage positive displacement pumping region downstream of, and communicating with, the non-positive displacement pumping region, and (4) at least one material discharge opening communicating with the second stage region.

In the first stage region there is provided a first stage auger means rotatable about an axis for moving material along the first stage auger means and having a non-positive displacement helical flight means configured around the first stage means axis for providing a non-positive displacement pumping action and a net positive suction head at the interface of the first and second stage regions.

Extending in the second stage region is a pair of second stage positive displacement auger means rotatable together about respective parallel axes for moving the material along the second stage auger means from the first stage region downstream to the material discharge opening. Each second stage auger means has positive displacement helical flight means configured within the pump housing for engaging the material and for being respectively intermeshed with the positive displacement helical flight means of the other one of the second stage auger means for providing positive displacement pumping.

A drive means is provided for rotatably driving the pair of second stage auger means and he first stage auger means.

In the preferred embodiment, the interior periphery of the pump housing in the first stage region is configured to extend axially along the first stage auger means in general conformity with the volume envelope defined by the periphery of the non-positive displacement helical flight means.

In the apparatus of the present invention, there is no pair of counter-rotating auger means in the first stage which could impose undesirable high shear forces on the material when the flow rate through the pump is limited by the positive displacement second stage.

With the pumping apparatus of the present invention, a two-stage pumping action is provided with the advantage that, if the first stage tends to feed the material at a higher flow rate than can be accommodated by the positive displacement second stage, then the shear forces imposed on the material first stage are significantly reduced because there is no counter-rotating second auger means in the first stage. Further, in the preferred embodiment wherein the pump housing is vertically oriented for gross movement of the material generally in the direction of gravity, the shear forces are also reduced by the action of the material rotating on, and with, the first stage helical flight means in the first stage region of the pump housing.

Further, with the preferred embodiment of the pumping apparatus of the present invention, the general conformity of the pump housing around the first stage auger means in the first stage region reduces the imposition of shear forces on the material being pumped.

Other features and advantages of the present invention will become readily apparent from the following detailed description, the accompanying drawings, and the appended claims.

DETAILED DESCRIPTION OF THE PREFERRED EMBODIMENT

Figure 1:
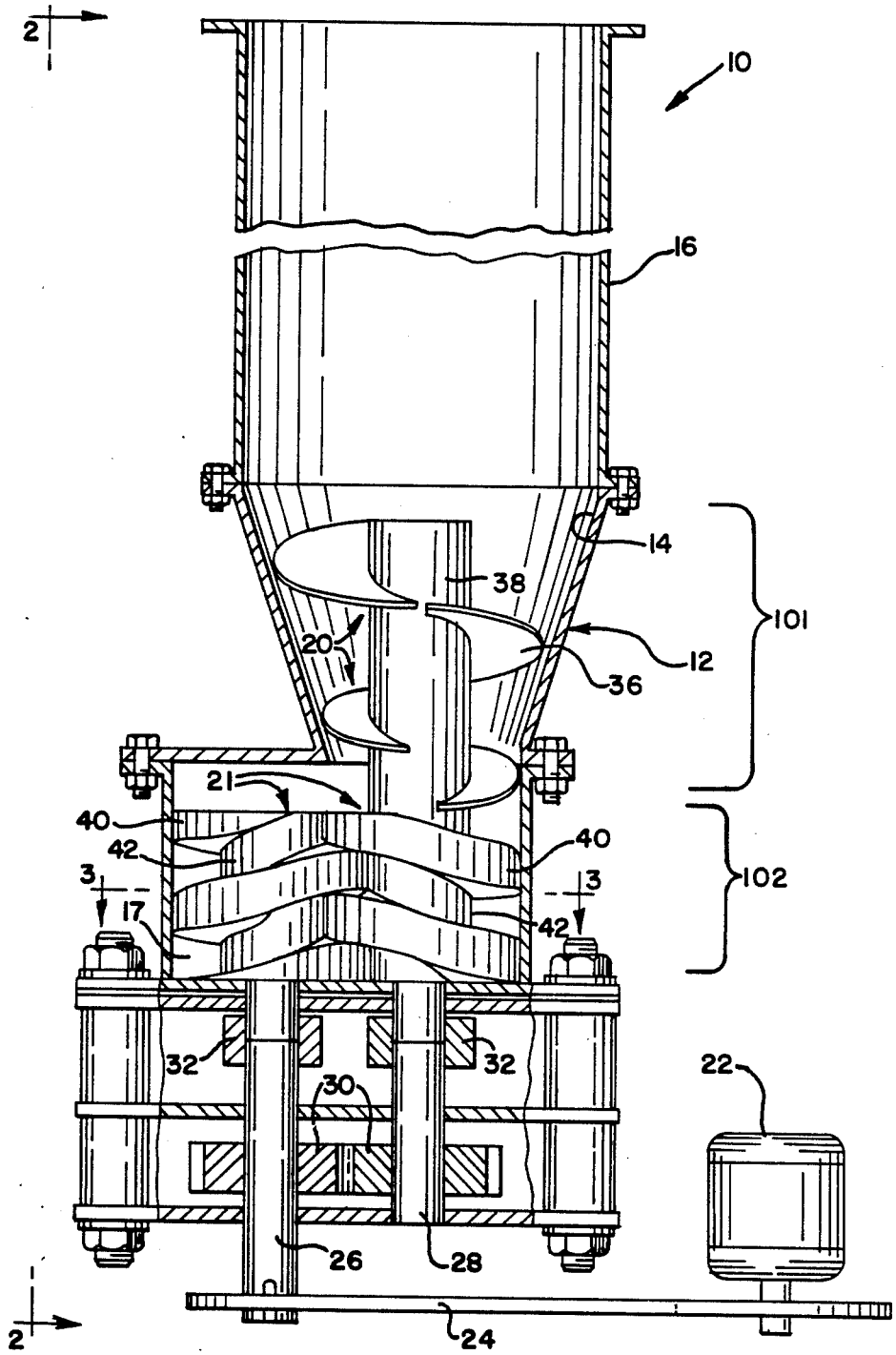
FIG. 1 is a diagrammatic, simplified, elevational view, partially in cross-section, of a two-stage pumping apparatus embodying the principles of the present invention.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiments illustrated.

For ease of description, the apparatus of this invention is described in the normal (upright) operating position, and terms such as upper, lower, horizontal, etc., are used with reference to this position. It will be understood, however, that the apparatus of this invention may be manufactured, stored, transported, and sold in an orientation other than the position described.

The apparatus of this invention is used with certain conventional components, including drive mechanisms and control mechanisms, the details of which, although not fully illustrated or described, will be apparent to those having skill in the art and in understanding of the necessary functions of such components.

Some of the Figures illustrating the embodiment of the apparatus show structural details and mechanical elements that will be recognized by one skilled in the art. However, the detailed descriptions of such elements are not necessary to an understanding of the invention, and accordingly, are not herein presented.

Figure 2:
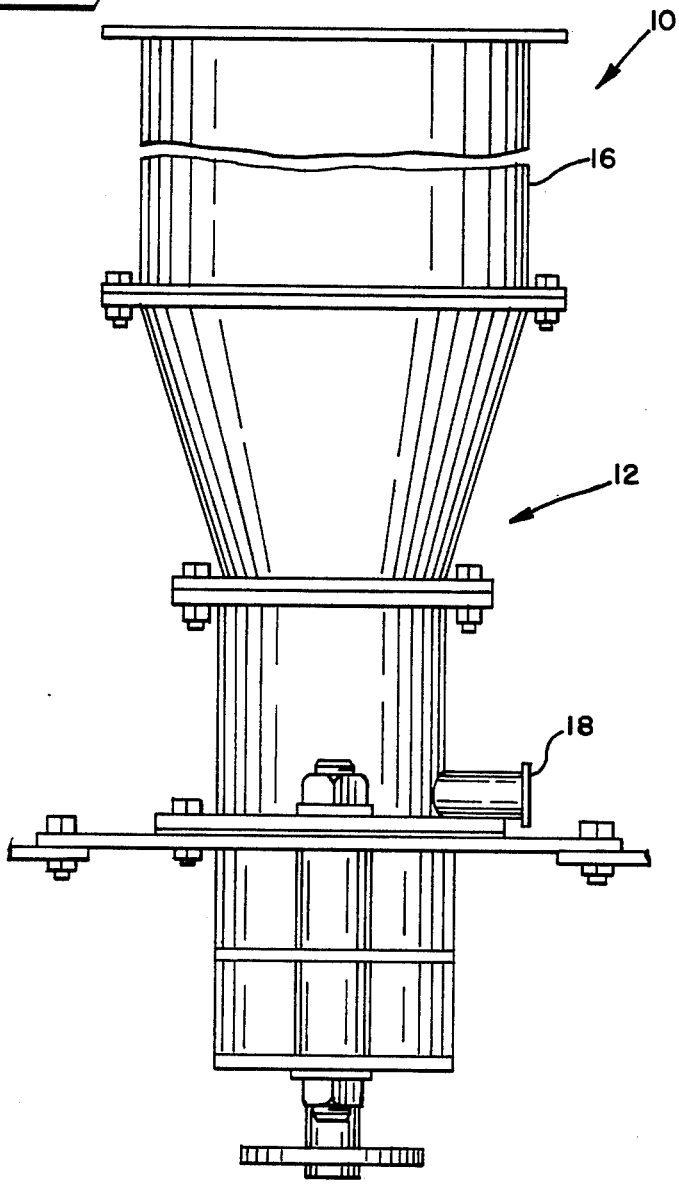
FIG. 2 is a fragmentary, side-elevational view of the pumping apparatus shown in FIG. 1.
Figure 3:
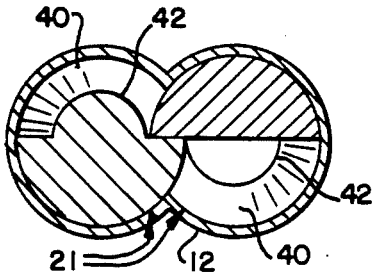
FIG. 3 is a cross-sectional view taken along plane 3—3 in FIG. 1.

Referring first to FIGS. 1, 2, and 3, there is illustrated a two-stage pumping apparatus 10 embodying the principles of the present invention. Notably, the pumping apparatus 10 is arranged for gravity infeed of material to be pumped, thus desirably promoting feeding of materials that otherwise may tend to resist movement into and through the pumping apparatus.

To this end, the apparatus 10 includes a pump housing 12 through which the material is pumped. In the preferred embodiment, the pump housing 12 is generally vertically oriented, and the gross movement of material occurs generally in the direction of gravity. The housing 12 defines a material infeed opening 14 generally at its upper end through which material is introduced into the apparatus 10, and the housing 12 has at least one material discharge opening 18 (FIG. 2).

The pump housing 12 also defines a first stage non-positive displacement pumping region 101 communicating with the infeed opening 14 and defines a second stage positive displacement pumping region 102 downstream of, and communicating with, the first stage region 101.

If desired, the apparatus 10 can be provided with an associated infeed hopper 16 extending generally upwardly from the infeed opening 14 for holding material being introduced by gravity into the pumping apparatus 10.

Movement of material through the pumping apparatus 10 is generally downwardly through pump housing 12 into a pressurized discharge cavity 17. Material is moved out of the apparatus 10 via the discharge opening 18 defined by the pump housing 12 in communication with the discharge cavity 17. While a single, generally centrally disposed discharge opening 18 is illustrated, it will be appreciated that a pump in accordance with the present teachings may instead include two or more spaced-apart discharge openings positioned generally in the lower region of the pump housing in communication with the discharge cavity 17.

Since material in the discharge cavity is continuously pressurized attendant to pump operation, two or more "streams" of material can readily be formed (by the provision of a corresponding number of discharge openings) without resort to additional flow dividers or the like. Thus, a single pumping apparatus 10 can readily be employed to supply material to more than one associated processing stream.

Movement of material generally downwardly through pump housing 12 is effected by a first stage auger means 20 in the first stage region 101 and by a pair of cooperating second stage auger means 21 in the second stage region 102. Both second stage auger means 21 are screw-type augers that are preferably generally mirror images of each other and are arranged for cooperating, counter-rotation about respective parallel axes within second stage region 102 of the pump housing 12. The interior of housing 12 in the second stage region 102 is preferably constructed to closely conform to the peripheral configuration of the pair of intermeshed auger means 21 to promote efficient material movement (see FIG. 3).

The illustrated embodiment of the present pumping apparatus 10 is arranged such that drive of the auger means 21 is effected generally at the downstream ends of the auger means 21. Driving of the auger means 21 may be effected by means of a suitable drive motor 22, which can be operatively connected with the auger means 21 such as by a drive belt or chain 24 extending to a driven stub shaft 26. An additional stub shaft 28 can be employed, with meshed, interconnecting gears 30 respectively affixed to the stub shafts 26 and 28 whereby opposite, concurrent rotation is effected.

Each of the stub shafts 26 and 28 is operatively connected with a respective one of the auger means 21 such as by means of a suitable drive coupling 32. Suitable conventional bearings and seals, not shown, are ordinarily employed for rotatably supporting the various components, and for sealing the interior of the pump housing 12 against leakage.

In this latter regard, it should be noted that the manner in which the auger drive system is operatively connected with the auger means 21 generally at their downstream ends promotes reliable and versatile use of the present pumping apparatus. As will be recognized by those familiar with the art, it is sometimes necessary to employ a pumping apparatus in a processing stream in which a vacuum is established and maintained generally at the upstream, infeed portion of the pumping apparatus. For example, such an arrangement is sometimes necessary in the processing of certain cheeses.

In a conventional pumping apparatus wherein the driving of its screw augers is effected generally at their upstream ends, it will be appreciated that dynamic drive shaft seals are required to effectively seal the vacuum established generally at the infeed of the pump. However, the construction and nature of dynamic seals is such that it is typically more difficult to dynamically seal a shaft against a vacuum, as opposed to dynamically sealing the shaft against positive pressure. Thus, the illustrated arrangement of the present pumping apparatus 10 wherein the driving of the auger means 21 is effected at their downstream ends very desirably permits the use of positive pressure dynamic seals at the drive shafts, since the region within the pump housing 12 whereat discharge cavity 17 is defined is subjected to positive pressure attendant to pump operation.

In the preferred embodiment illustrated, the first stage auger means 20 is located above, and preferably concentric with, the axis of one of the pair of second stage auger means 21. Preferably, the first stage auger means 20 is integral with, and extends coaxially from, the upstream end of one second stage auger means 21. To this end, that second stage auger means 21 has an auger core 42 extending longitudinally in the second stage region 102 and includes a projection 38 extending into the first stage region 101 for functioning as the first stage auger means core.

The first stage auger means 20 has a non-positive displacement helical flight means 36 configured around the first stage auger means vertical axis for providing non-positive displacement pumping and for providing a net positive suction head at the interface of the first stage region 101 and second stage region 102.

The first stage helical flight means 36 extends outwardly from the first stage auger means core 38. The periphery of the first stage helical flight means 36 may be characterized as defining a volume envelope around which is disposed the portion of the pump housing 12 defining the first stage region 101.

In the preferred embodiment illustrated, the first stage non-positive displacement helical flight means 36 tapers radially inwardly and decreases in radial dimension so that the periphery of the flight means 36 decreases in the direction of gross movement through the apparatus first stage region 101. As illustrated, the pump housing 12 in the first stage region 101 is generally tapered around the first stage flight means 36 and has a circular cross section of decreasing dimension in the direction corresponding to the direction of gross movement of the material through the pump first stage region 101.

In other forms of the apparatus, the upper distal end of the first stage auger means core 38 may be tapered or pointed so as to promote "piercing" of material which is being fed by gravity into the pumping apparatus 10. This could reduce problems of "tunneling" and "bridging," such as have been common with previous constructions, without resort to additional driven feed rollers or the like.

Further, the first stage flight means 36 may have a constant peripheral diameter along the longitudinal length of the core 38 in the first stage region 101. Further, the core 38 may have a configuration other than the cylindrical configuration illustrated. For example, the core 38 may have a frustoconical shape with the larger diameter portion located at the top opening 14 or, alternatively, with the larger diameter portion located at the bottom of the first stage region 101.

It will also be appreciated that the helical flight means 36 in the first stage region 101 may have a decreasing pitch to desirably provide progressively increasing pressures in the direction of material movement within the first stage region 101.

As will be recognized, the first stage flight means 36 is preferably configured as a so-called Archimedian screw to provide a non-positive pumping action. In other words, the configuration of the flight means 36 acts to urge material downwardly within the first stage region 101 in the pump housing 12, but does not provide a positive pumping displacement such as in the nature of pumps having cooperating multi-lobular rotors or the like.

While the auger means 20 provides a non-positive displacement action in the first stage region 101, the auger means 21 in the lower, downstream second stage region 102 have each been specifically configured to provide a positive displacement pumping. As will be observed, each auger means 21 has a positive displacement helical flight means 40. Each flight means 40 of one of the pair of auger means 21 is configured to closely conform and mesh with the flight 40 means and core 42 of the other auger means 21, whereby a positive displacement pumping action is provided, much in the nature of a positive displacement pump having lobular rotors. Close conformance of the pump housing 12 to the peripheries of flight means 40 in the second stage region 102 promotes this positive displacement action.

Thus, the present arrangement desirably provides two pumping stages in immediate succession while still employing means which can be driven together by but a single drive.

In view of the positive displacing nature of the second stage auger flight means 40, it may be preferred in some situations that these flight means 40 terminate in spaced relation to the end of the interior of pump housing 12 to thus define a lower discharge cavity (not illustrated). This arrangement could help to prevent any inadvertent jamming of the auger means 21, which might otherwise occur in some situations in view of the positive displacing nature of second stage flight means 40.

By providing the first and second stage pumping regions 101 and 102 in immediate succession, a pressure drop at the transition is desirably avoided. A pressure drop at the interface of the first and second stage pumping regions 101 and 102 is further avoided by configuring second stage auger means core 42 to be of the same diameter as the lower end of first stage auger means core 38. Streamlined flow is thus promoted.

Further, the non-positive first stage region 101 desirably acts to create a net positive suction head at the second stage region 102, thereby avoiding "starving" the second stage and causing cavitation. To further avoid cavitation in the second stage region 102, the first stage flight means 36 can preferably be configured to provide a slight "overfeeding" (i.e., supply an excess of material) to the second stage flight means 40. In prior art pump designs, this could result in excessive shearing and heating of the material being pumped, and the degree of overfeeding which the flight means 36 is configured to provide is preferably selected in accordance with the specific application of the pumping apparatus and material being pumped.

As discussed in the section entitled "BACKGROUND OF THE INVENTION AND TECHNICAL PROBLEMS POSED BY THE PRIOR ART," shear forces may be imposed by conventional apparatus on the overfed material as the material "slips" relative to the first stage flight means or relative to some of the other material that is being carried with, and pumped by, the first stage flight means. In contrast, it has been discovered that the unique design of the present invention pumping apparatus substantially eliminates, or at least greatly reduces, the imposition of shear forces during the over feeding condition.

In particular, it has been found that the present invention apparatus 10, when operated so as to result in a tendency to overfeed material from the first stage region 101 to the second stage region 102, imposes lower and fewer shear forces on the material since there is no second, counter-rotating auger means in the first stage next to the single auger means 20. That is, the first stage region 101 does not have a second, adjacent, auger means intermeshed with the one first stage auger means 20. This avoids the creation of additional material movements within the first stage region 101 that could lead to the imposition of additional shear forces on the material.

Additionally, the preferred embodiment, wherein the apparatus is vertically oriented to accommodate gross movement of the material generally in the direction of gravity, operates with reduced forces for an additional reason. In particular, the vertical first stage auger means 20 permits a substantial portion of the material in the region 101 to be carried on the rotating flight means 36 and to rotate with the flight means 36. Thus, since much of the material in the first stage region 101 is carried directly on the rotating flight means 36 in an overfeed condition, less material is subjected to shear forces generated by relative movement between the rotating flight means 36 and the material.

Indeed, in the preferred embodiment illustrated, the single first stage auger means 20 is centrally disposed in the first stage region 101 of the housing 12, and that portion of the housing 12 surrounding the first stage auger means 20 in the first stage region 101 has a generally smooth, interior surface in general conformity with the volume envelope defined by the periphery of the first stage helical flight means 36. Thus, as the first stage auger means 20 rotates, even in an overfeed condition relative to the second stage region 102, the material which cannot be accommodated by the second stage auger means 21 will rotate on and with the first stage flight means 36 at considerably reduced shear loadings. The shear strain imposed on the material is therefore considerably reduced. This eliminates, or at least substantially reduces, the tendency of shear-sensitive material to be deleteriously effected.

It will be further appreciated that the location of the first stage auger means 20 generally directly above, and preferably coaxially aligned with, one of the lower, second stage auger means 21, operates to feed the material into the second stage region 102 in an efficient manner with reduced pressure drop at the interface of the first stage region 101 and second stage region 102.

With the design of the present invention, material tends to advantageously be pumped through the apparatus 10 in a "first in-first out" manner. This is particularly well suited for use in pumping food materials.

Further, the frustoconical shaped first stage region 101 of the pump housing 12 and the complementary shape of the first stage auger means 20 provide an improved material transport through the pump with reduced material shear strain under various conditions and with various materials.

From the foregoing, it will be observed that numerous modifications and variations can be effected without departing from the true spirit and scope of the novel concept of the present invention. It is to be understood that no limitation with respect to the specific embodiments disclosed herein is intended or should be inferred. The disclosure is intended to cover by the appended claims all such modifications as fall within the scope of the claims.

What is claimed is:

1. A two-stage pumping apparatus comprising:

a pump housing through which material is pumped, said housing defining (1) a material infeed opening, (2) a first stage non-positive displacement pumping region communicating with said infeed opening, (3) a second stage positive displacement pumping region downstream of, and communicating with, said first stage region, and (4) at least one material discharge opening communicating with said second stage region;

a first stage auger means in the form of a single rotor in said first stage region rotatable about an axis for moving material along said first stage auger means and having non-positive displacement helical flight means configured around said first stage auger means axis for providing non-positive displacement pumping and a net positive suction head at the interface of said first and second stage regions;

a pair of second stage positive displacement auger means extending in said second stage region rotatable together about respective parallel axes for moving said material along said second stage auger means from said first stage region downstream to said material discharge opening, each of said second stage auger means having positive displacement helical flight means configured for engaging said material and for being respectively intermeshed with the positive displacement helical flight means of the other one of said second stage auger means for providing positive displacement pumping;

said first stage auger means single rotor being parallel to or coaxial with one of said second stage auger means; and drive means for rotatably driving said pair of second stage auger means and said first stage auger means.

2. The apparatus in accordance with claim 1 in which the interior periphery of said pump housing in said first stage region is configured to extend axially along said first stage auger means in general conformity with the volume envelope defined by the periphery of said non-positive displacement helical flight means.

3. The apparatus in accordance with claim 1 in which said pump housing defines said material infeed opening in an orientation relative to said first stage auger means to facilitate said gravity infeed of material in a direction generally axially of said first stage auger means, said infeed opening being aligned with the axis of said first stage auger means so that a component of the direction of material movement through said infeed opening is parallel with said first stage auger means axis.

4. The apparatus in accordance with claim 1 in which said infeed opening has a circular configuration in a plane normal to said first stage auger means axis; and said infeed opening is concentric said first stage auger means axis.

5. The apparatus in accordance with claim 1 in which said drive means includes drive coupling means operatively connected with said second stage auger means generally at the downstream ends thereof.

6. The apparatus in accordance with claim 1 in which said first stage auger means is integral with, and extends coaxially from, the upstream end of one of said pair of second stage auger means.

7. The apparatus in accordance with claim 1 in which said first stage auger means single rotor is coaxial with one of said positive displacement stage auger means.

8. The apparatus in accordance with claim 1 in which said driving means rotatably drives said pair of second stage auger means in counter-rotating relation to each other.

9. The apparatus in accordance with claim 1 in which said pump housing includes a generally tapered portion around said first stage auger means and has a circular cross section of decreasing dimension in a direction corresponding to the direction of gross movement of material through said pump housing; and the radial dimension of said first stage non-positive displacement helical flight means periphery decreases in said direction of gross movement so that said non-positive displacement helical flight means are complemental to said generally tapered portion of said housing.

10. The apparatus in accordance with claim 1 in which each said auger means comprises a generally cylindrical core outwardly from which the respective helical flight means extends.

11. The apparatus in accordance with claim 1 in which said pump housing is oriented to accommodate the gross movement of said material generally in the direction of gravity.

12. A two-stage pumping apparatus comprising:

a pump housing through which gross movement of material occurs generally in the direction of gravity, said housing defining (1) a material infeed opening in an orientation for gravity infeed of material into said pumping apparatus and (2) at least one material discharge opening;

a pair of positive displacement stage auger means extending within said pump housing, each said positive displacement stage auger means being rotatable together about respective parallel axes for moving material in said housing along said positive displacement stage auger means downstream to said material discharge opening, each of said positive displacement stage auger means having positive displacement helical flight means for engaging said material and for being respectively intermeshed with the positive displacement helical flight means of the other one of said positive displacement stage auger means, said positive displacement helical flight means of each positive displacement stage auger means being configured within said pump housing for providing positive displacement pumping;

non-positive displacement stage auger means in the form of a single rotor extending above said pair of positive displacement stage auger means within said pump housing and being rotatable about an axis for moving material in said housing along said non-positive displacement stage auger means, said axis of said non-positive displacement stage auger means being parallel to an axis of one of said pair of positive displacement stage auger means, said non-positive displacement stage auger means having a non-positive displacement helical flight means configured for providing a non-positive displacement pumping and a net positive suction head at the interface of said non-positive displacement helical flight means and said positive displacement helical flight means;

said non-positive displacement stage auger means single rotor being parallel to or coaxial with one of said positive displacement stage auger means;

said pump housing defining said material infeed opening in an orientation relative to said non-positive displacement stage auger means to facilitate said gravity infeed of material in a direction generally axially of said non-positive displacement stage auger means, said infeed opening being aligned with the axis of said non-positive displacement stage auger means so that material moving through said infeed opening moves along said non-positive displacement stage auger means; and drive means for rotatably driving said pair of positive displacement stage auger means and said non-positive displacement stage auger means.

13. The apparatus in accordance with claim 12 in which said infeed opening has a circular configuration in a plane normal to said non-positive displacement stage auger means axis; and said infeed opening is concentric with said non-positive displacement stage auger means axis.

14. The apparatus in accordance with claim 12 in which said drive means includes drive coupling means operatively connected with said positive displacement stage auger means generally at the downstream ends thereof.

15. The apparatus in accordance with claim 12 in which said non-positive displacement stage auger means is integral with, and extends coaxially from, the upstream end of one of said pair of positive displacement stage auger means.

16. The apparatus in accordance with claim 12 in which said non-positive displacement stage auger means is coaxial with one of said positive displacement stage auger means.

17. The apparatus in accordance with claim 12 in which said driving means rotatably drives said pair of positive displacement stage auger means in counter-rotating relation to each other.

18. A two-stage pumping apparatus comprising:

a pump housing through which gross movement of material occurs generally in the direction of gravity, said housing defining (1) a material infeed opening in an orientation for gravity infeed of material into said pumping apparatus and (2) at least one material discharge opening;

a pair of positive displacement stage auger means extending within said pump housing, each said positive displacement stage auger means being rotatable together about respective parallel axes for moving material in said housing along said positive displacement stage auger means downstream to said material discharge opening, each of said positive displacement stage auger means having positive displacement helical flight means for engaging said material and for being respectively intermeshed with the positive displacement helical flight means of the other one of said positive displacement stage auger means, said positive displacement helical flight means of each positive displacement stage auger means being configured within said pump housing for providing positive displacement pumping;

non-positive displacement stage auger means extending above said pair of positive displacement stage auger means within said pump housing and being rotatable about an axis for moving material in said housing along said non-positive displacement stage auger means, said axis of said non-positive displacement stage auger means being parallel to an axis of one of said pair of positive displacement stage auger means, said non-positive displacement stage auger means having a non-positive displacement helical flight means configured for providing a non-positive displacement pumping and a net positive suction head at the interface of said non-positive displacement helical flight means and said positive displacement helical flight means;

said pump housing defining said material infeed opening in an orientation relative to said non-positive displacement stage auger means to facilitate said gravity infeed of material in a direction generally axially of said non-positive displacement stage auger means, said infeed opening being aligned with the axis of said non-positive displacement stage auger means so that material moving through said infeed opening moves along said non-positive displacement stage auger means;

drive means for rotatably driving said pair of positive displacement stage auger means and said non-positive displacement stage auger means;

said pump housing including a generally tapered portion around said non-positive displacement auger means and having a circular cross section of decreasing dimension in a direction corresponding to the direction of gross movement of material through said pump housing; and the radial dimension of said non-positive displacement helical flight means periphery decreasing in said direction of gross movement so that said non-positive displacement helical flight means are complemental to said generally tapered portion of said housing.

19. The apparatus in accordance with claim 12 in which each said auger means comprises a generally cylindrical core outwardly from which the respective helical flight means extends.

20. A method for flowing difficultly flowable material which comprises introducing said material into an infeed opening of a housing that has infeed and discharge openings generally at opposite ends and through which material is pumped, rotating a single rotor helical flight means for engaging said material in a first stage region of said housing, moving said material through the first stage region to a second stage region by the action of said single rotor helical flight means effecting non-positive displacement pumping, thereafter moving said material through the second stage region by rotating a pair of second stage helical flight means for engaging said material in said second stage region with one of said second stage region helical flight means oriented parallel to or coaxial with said first stage single rotor helical flight means to effect positive displacement pumping, and thereafter discharging said material through said discharge opening.

21. The method in accordance with claim 20 including the step of orienting the pump housing generally vertically to accommodate gross movement of said material generally in the direction of gravity.

* * * * *